US009675985B2

(12) United States Patent
Alluigi

(10) Patent No.: US 9,675,985 B2
(45) Date of Patent: Jun. 13, 2017

(54) TRIGGER DISPENSER DEVICE

(71) Applicant: GUALA DISPENSING S.p.A., Alessandria (IT)

(72) Inventor: Riccardo Alluigi, Alessandria (IT)

(73) Assignee: GUALA DISPENSING S.p.A., Alessandria (IT)

( * ) Notice: Subject to any disclaimer, the term of this patent is extended or adjusted under 35 U.S.C. 154(b) by 44 days.

(21) Appl. No.: 14/416,251

(22) PCT Filed: Apr. 30, 2013

(86) PCT No.: PCT/IB2013/053395
§ 371 (c)(1),
(2) Date: Jan. 21, 2015

(87) PCT Pub. No.: WO2014/016709
PCT Pub. Date: Jan. 30, 2014

(65) Prior Publication Data

US 2015/0190828 A1 Jul. 9, 2015

(30) Foreign Application Priority Data

Jul. 24, 2012 (IT) ..... BS2012A0116

(51) Int. Cl.
*B05B 11/00* (2006.01)

(52) U.S. Cl.
CPC ..... *B05B 11/3011* (2013.01); *B05B 11/3045* (2013.01); *B05B 11/3069* (2013.01)

(58) Field of Classification Search
CPC ..... B05B 11/3057; B05B 11/3011; B05B 11/3069; B05B 11/3045
USPC ..... 222/380–381, 321.7, 383.1, 340–341; 239/333
See application file for complete search history.

(56) References Cited

U.S. PATENT DOCUMENTS 4,489,861 A * 12/1984 Saito ..... B05B 11/3011 137/512.4
5,575,407 A 11/1996 Foster et al.
5,884,845 A * 3/1999 Nelson ..... B05B 1/3431 222/383.1
5,984,149 A * 11/1999 Thanisch ..... B05B 11/007 222/340
9,033,190 B2 * 5/2015 Alluigi ..... B05B 11/3011 222/321.8

(Continued)

FOREIGN PATENT DOCUMENTS

EP 1 974 826 A1 10/2008
WO WO 00/33970 A1 6/2000
WO WO 2012/069939 A1 5/2012

OTHER PUBLICATIONS

International Search Report for corresponding International Patent Application No. PCT/IB2013/053395 mailed Sep. 3, 2013.

*Primary Examiner* — Paul R Durand
*Assistant Examiner* — Robert Nichols, II
(74) *Attorney, Agent, or Firm* — Merchant & Gould P.C.

(57) ABSTRACT

A trigger dispenser device (1) for a liquid includes a dispenser head (20) provided with a pressure chamber (24) and a piston (26) sliding in the pressure chamber (24). A valve dispenser is provided to permit the passage of the liquid towards a dispenser duct (30) upon reaching a threshold pressure, and a trigger suitable for mechanically operating on dispenser valve to force the valve towards the open configuration.

8 Claims, 10 Drawing Sheets

(56) References Cited

U.S. PATENT DOCUMENTS

| | | | | |
|---|---|---|---|---|
| 2008/0230563 | A1* | 9/2008 | Maas | B05B 11/0062 222/383.1 |
| 2009/0308897 | A1* | 12/2009 | Foster | B05B 11/3011 222/383.1 |
| 2015/0343472 | A1* | 12/2015 | Tada | B05B 11/0016 222/380 |

* cited by examiner

TRIGGER DISPENSER DEVICE

This application is a National Stage Application of PCT/IB2013/053395, filed 30 Apr. 2013, which claims benefit of Serial No. BS2012A000116, filed 24 Jul. 2012 in Italy and which applications are incorporated herein by reference. To the extent appropriate, a claim of priority is made to each of the above disclosed applications.

BACKGROUND OF THE INVENTION

The present invention relates to a trigger dispenser device for a liquid.

Triggered dispenser devices are extremely widespread and the production volumes of such devices are enormous; every year several hundred million pieces are produced.

As a result, even slight improvements to the production process entail significant economic benefits.

For such reason, the development of new products aims above all at integrating the components of the device so as to have a smaller number of components and simpler, faster assembly to make production more economically advantageous.

However, production requirements need to marry the need for a highly reliable dispenser device, efficiently functioning for example in the liquid dispensing phase.

SUMMARY OF THE INVENTION

The purpose of the present invention is to satisfy the aforementioned requirements and overcome the drawbacks of the prior art, by making a dispenser device having a structure which is simple and fast to assemble and highly efficient in its functioning.

BRIEF DESCRIPTION OF THE DRAWINGS

The characteristics and advantages of the dispenser device according to the present invention will be evident from the following description, made by way of a non-limiting example, with reference to the attached drawings, wherein.

DETAILED DESCRIPTION OF THE PREFERRED EMBODIMENTS

Figure 1:
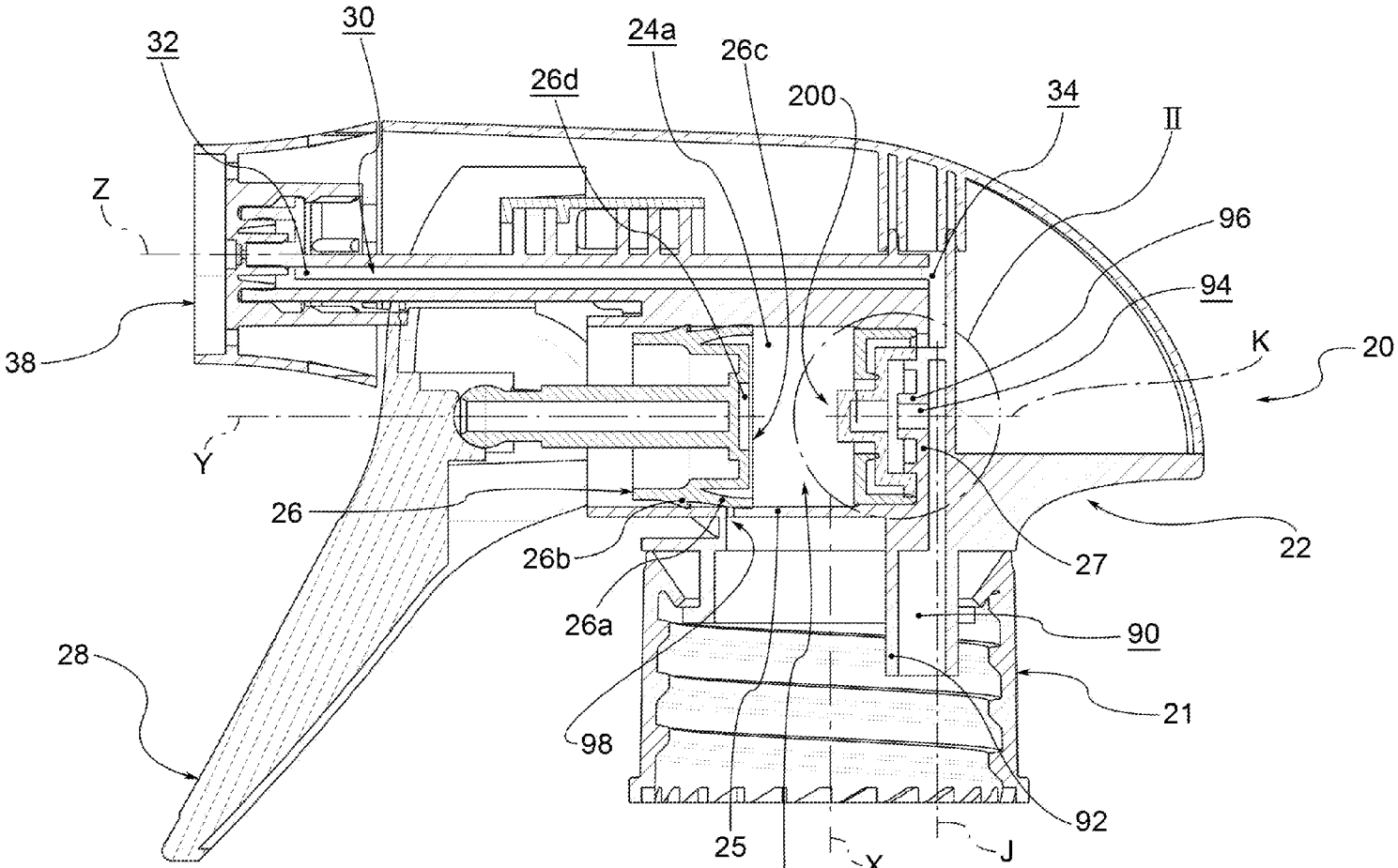
FIG. 1 shows a cross-section view of a dispenser head of a triggered dispenser device in a rest configuration according to an embodiment of the present invention.

With reference to the appended drawings, a manual dispenser device 1 comprises a container having an inner compartment for containing the liquid to be dispensed, comprising a neck made by a wall annular around a container axis X, which defines by means of an annular rim, a container aperture for access to the inside thereof.

The dispenser device comprises a dispenser head 20 attached to the container to manually aspirate the liquid from the dispenser and dispense it to the outside.

The head 20 is pre-assembled and in general is sent for filling the container separately from it. After filling the container with liquid, the head is coupled to the container.

For example, the head 20 is suitable for coupling to the container by means of a threaded fastening comprising a threaded ring-nut 21 (as illustrated) or by means of a bayonet fastening.

The head 20 further comprises a frame 22 suitable for coupling to the container, preferably made in one piece, for the support of the other components and for the realisation of several passages for the liquid.

The frame 22 has a pressure chamber 24, annularly defined by a chamber wall 25, extending along a pressure axis Y, preferably incident to the container axis X, for example orthogonally, and on the bottom by a bottom wall 27.

The head 20 comprises a piston 26, sealingly sliding in the pressure chamber 24 along the pressure axis Y, between a rest position, in which the volume of the pressure chamber 24 is maximum, and a limit dispensing position, in which the volume of the pressure chamber 24 is minimal, passing through intermediate dispensing positions. The area of the pressure chamber 24 which the piston 26 slides in is defined as the main chamber 24*a*.

Preferably the piston 26 comprises a head seal 26*b* and a tail seal 26*b*, distanced from the head seal along the pressure axis Y, for the seal between the piston and the chamber wall 25 which it slides in.

At the front, the piston 26 has a main side 26*c*, which a recess 26*d* is preferably made on, for example aligned with the pressure axis Y.

The head 20 further comprises manual actuation means suitable for manually moving the piston 26 in the main compartment 24*a* of the pressure chamber 24.

Preferably the actuation means comprise a trigger 28, suitable for acting on the piston 26, for example anchored to it, for example hinged so as to rotate or slide in translation.

Preferably moreover, the head 20 comprises elastic return means suitable for permanently pressing the piston 26 or the trigger 28 to return the piston 26 towards the rest position.

The frame 22 further presents a dispenser duct 30 extending along a dispensing axis Z, between a distal end 32, at the aperture towards the outside, and an opposite proximal end 34.

Preferably the pressure axis Y is parallel and distinct from the dispenser axis Z.

The head 20 further comprises, preferably, a nozzle 38, attached to the distal end 32 of the dispenser duct 30, to permit the dispensing of the liquid in the desired manner.

The frame 22 preferably comprises an aspiration duct 90, suitable for placing the compartment inside the container in communication with the pressure chamber 24, which extends along an aspiration axis J, preferably orthogonal to the pressure axis Y.

For example, at least a section of the aspiration duct 90 is defined by an aspiration duct wall 92, projecting towards the inner compartment of the container, suitable for the application of a lift pipe.

Moreover, the frame 22 has a mouth 94, which opens through the bottom wall 27 of the pressure chamber 24 and which places the aspiration duct 90 in communication with said pressure chamber 24; the mouth 90 is delimited annularly by a mouth wall 96, which extends along a mouth axis K, preferably orthogonal to the aspiration axis J and thus parallel to the pressure axis Y. Preferably, the mouth axis K coincides with the pressure axis Y.

Moreover, the pressure chamber 24 has a dispenser opening 29, passing through the bottom wall 27, in communication with the dispenser duct 30.

Moreover, the frame 22 comprises a vent duct 98 suitable for placing the compartment inside the container in communication with the external environment; said vent duct 98 opens outside on the sliding surface which the sealing lips 26*a*, 26*b* of the piston 26 slide on.

The head 20 further comprises integrated valve means for regulating the entrance/exit of the dispenser liquid to/from the main compartment 24*a* of the pressure chamber 24.

The integrated valve means comprise a main body 200, positioned at the mouth 94, for example contained in the pressure chamber 24, made in a flexible material, for example in EVA (ethyl-vinyl-acetate), LDPE (low density polyethylene) or TPE (thermoplastic elastomers).

The main body 200 comprises an annular membrane 202 having a membrane axis M; preferably the membrane is disc-shaped.

The main body 200 further comprises a body skirt 204, projecting axially from the membrane 202, and a foot 206, for example in several portions 206*a*, 206*b*, projecting radially from the end of the body skirt 204.

Moreover, the main body 200 comprises a tubular tang 208, projecting axially from the membrane 202 on the side opposite the body skirt 204, preferably coaxial with said membrane axis M.

Moreover, the main body 200 comprises a lip 210, preferably in one piece with the tang 208, which can be sealed tight with said tubular tang 208 so as to close off a cut 212.

The main body 200 is preferably housed on the bottom of the pressure chamber 24, in abutment with the end wall 27, so that between the main body 200 and said bottom wall 27 an intermediate compartment 220 is formed.

Preferably, the membrane axis M coincides with the mouth axis K.

Moreover, the head 20 comprises a sleeve 300 suitable for engaging with the main body 200 of the integrated valve means, and in particular suitable for being housed in the pressure chamber 24.

Preferably, the sleeve 300 is made in a single piece, in a rigid material compared to the material of the main body, for example in PP (polypropylene).

The sleeve 300 comprises base 302, for example in the shape of a flat disc, and a sleeve skirt 304, projecting axially from the base 302, thus delimiting a sleeve compartment. The base 302 has a through opening 306, annularly defined by an abutment wall 308, projecting axially from the sleeve skirt 304.

When the sleeve 300 is housed in the pressure chamber in abutment with the bottom wall 27, between the base 302 of the sleeve 300 and the membrane 202 of the main body 200 a dispensing passage 310 is made in communication with the dispenser duct 30 through the dispensing aperture 29 of the pressure chamber 24.

Preferably moreover, the lip 210 of the main body 200 and preferably also a section of the tang 208, projects axially from the opening 306 of the sleeve 300.

Figure 2:
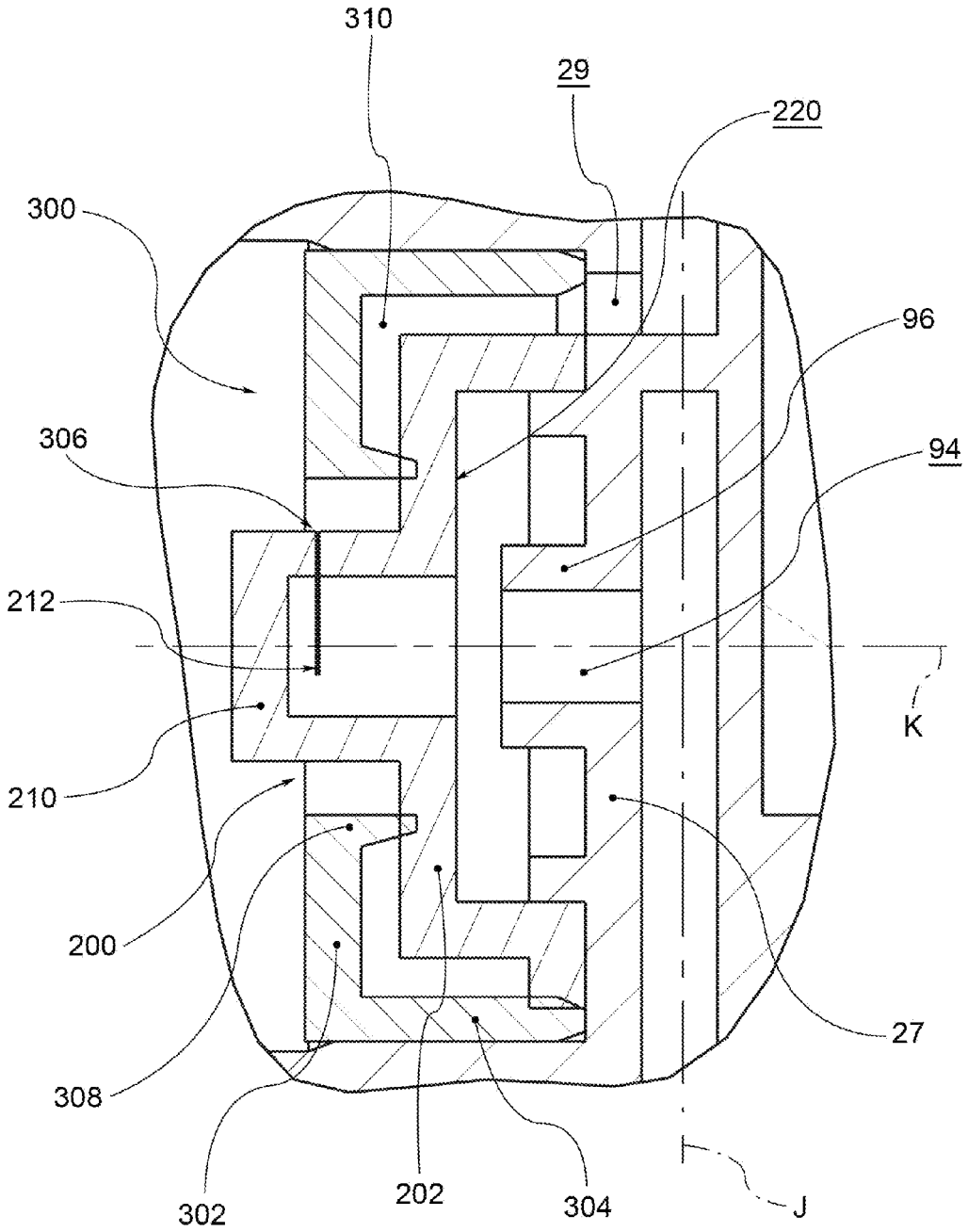
FIG. 2 shows an enlargement of the area II in FIG. 1.
Figure 3:
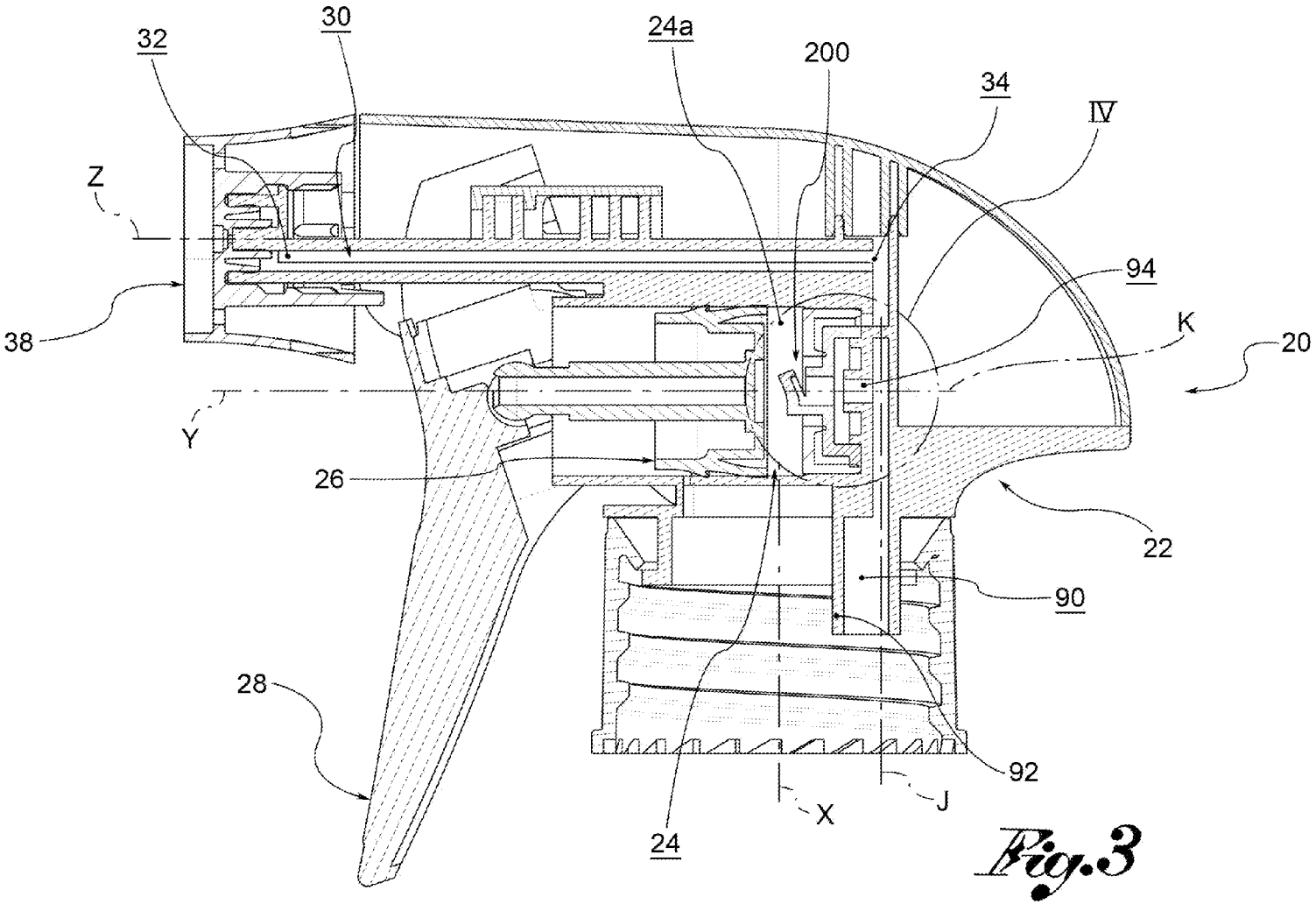
FIG. 3 shows the dispenser head in FIG. 1, in a suction configuration.
Figure 4:
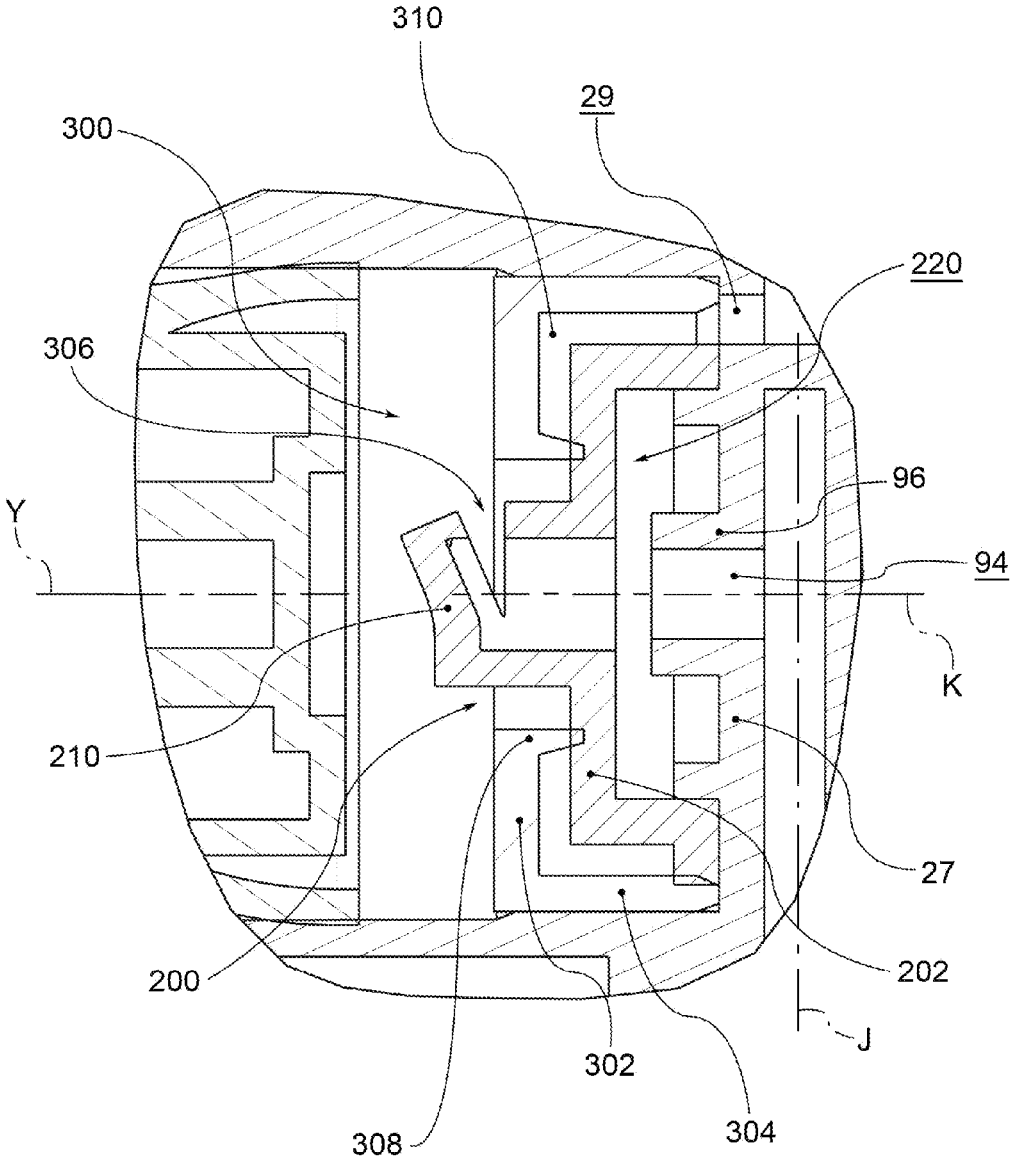
FIG. 4 shows an enlargement of the area IV in FIG. 3.

In an initial rest configuration (FIGS. 1 and 2), the piston 26 is in the rest position and the membrane 202 is sealed in abutment with the abutment wall 308 of the sleeve; the main compartment 24*a* of the pressure chamber 24 is thus fluidically separate from the dispensing passage 310 and thus from the dispenser duct 30.

Considering that a quantity of liquid is already present in the main compartment 24*a* of the pressure chamber 24, by operating the trigger, an active step is started in which the piston 26 operates under pressure in the main compartment 24*a* of the pressure chamber 24, trying to push the liquid out of said compartment 24.

the liquid acts on the lip 210 of the main body 200 in the closing direction of the cut 212; consequently the liquid does not pass into the intermediate compartment 220 and does not return into the container compartment through the aspiration duct 90.

The lip 210 of the main body 200, the cut 212 and the tang 208 thus form an example of embodiment of the check valve means suitable for preventing the return of the liquid from the main compartment 24*a* of the pressure chamber 24 to the inner compartment V of the container C during the active step.

Moreover, the liquid acts on at least part of the membrane 202 (in particular, on the inner crown thereof, positioned radially inwards of the contact line with the abutment wall 308), developing an action which deforms said membrane 202 as far as detaching it from the abutment wall 308.

Figure 5:
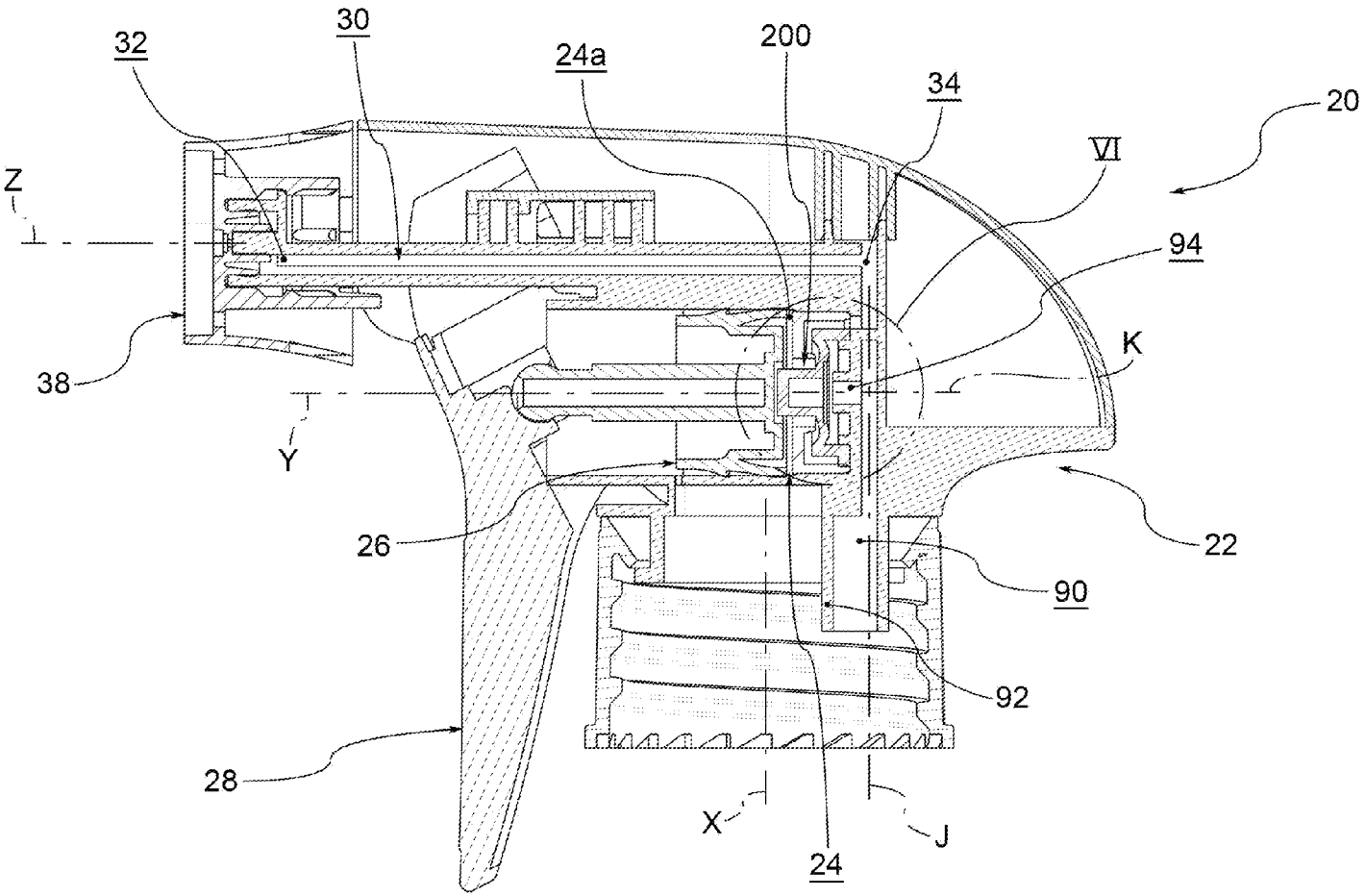
FIG. 5 shows the dispenser head in FIG. 1, in a dispensing configuration.
Figure 6:
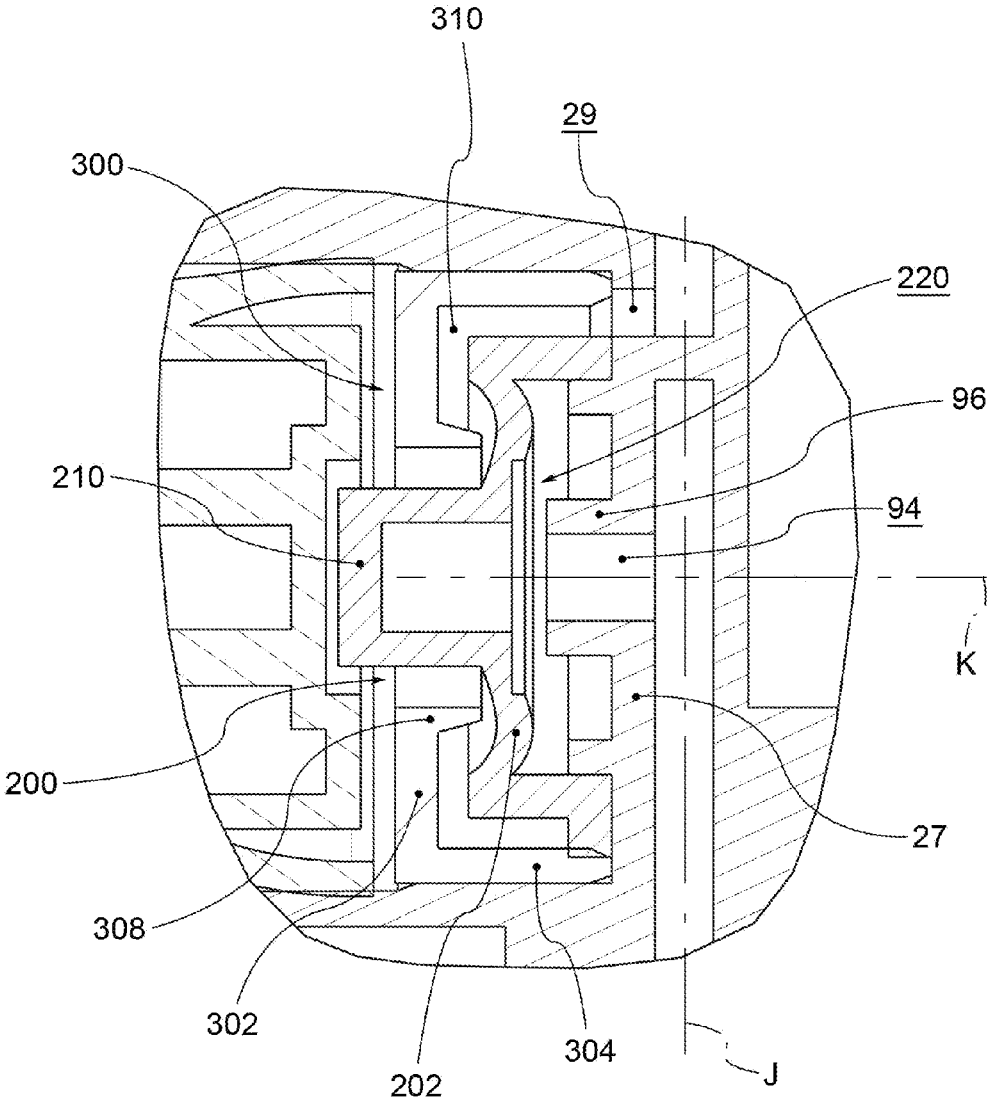
FIG. 6 shows an enlargement of the area VI in FIG. 5.
Figure 8:
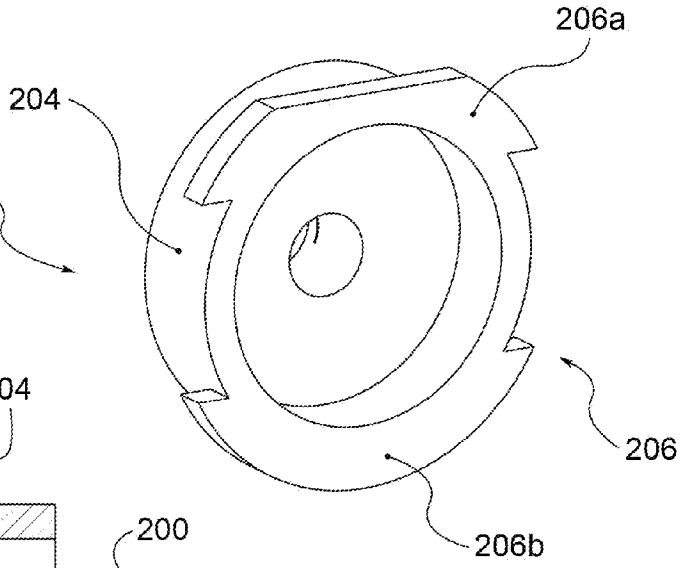
FIGS. 7 and 8 show a main body of the valve means integrated in the dispenser head in FIG. 1.
Figure 9:
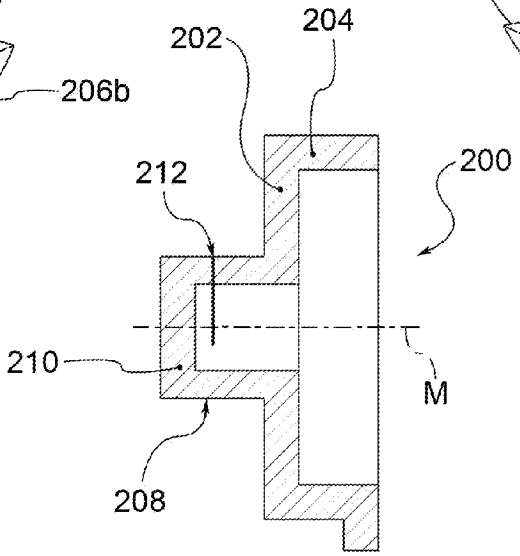
FIG. 9 shows a cross-section view of the main body in FIGS. 7 and 8.
Figure 7:
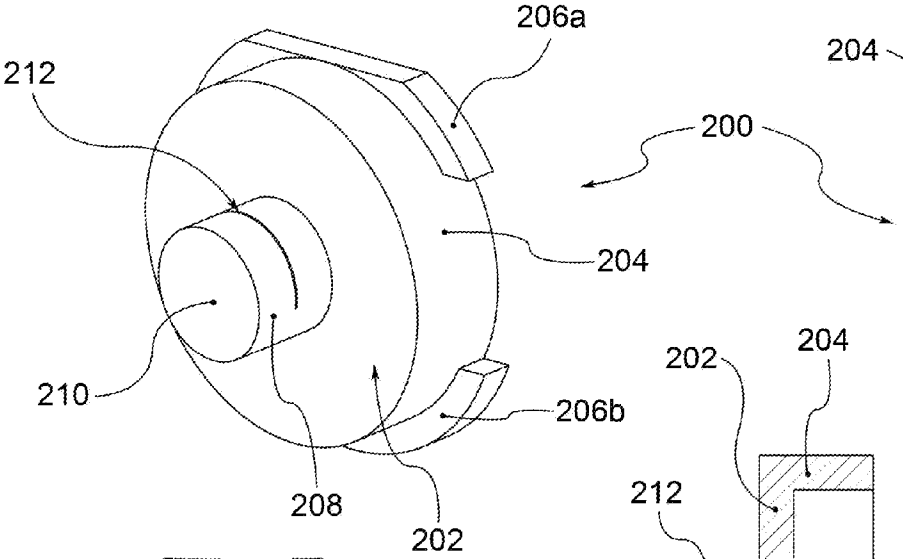
Figure 10:
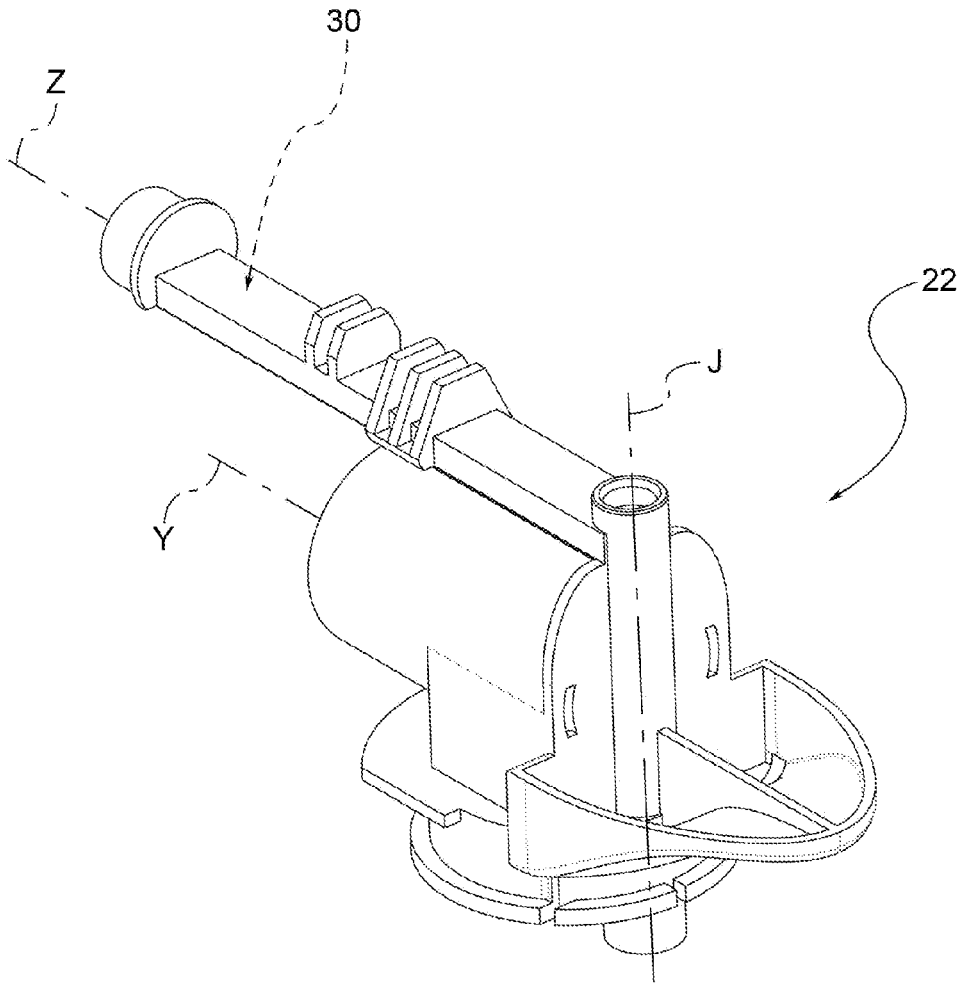
FIG. 10 shows a frame of the dispenser head in FIG. 1.

The dispenser head thus moves into a dispensing configuration, in which the membrane 202 is separate from the abutment wall 308 and the main compartment 24*a* of the pressure chamber 24 is in communication with the dispensing passage 310 and, through the dispensing aperture 29, with the dispenser duct 30, permitting the dispensing of the liquid outside (FIGS. 5 and 6).

The membrane 202 of the central body 200, co-operating with the abutment wall 308 of the sleeve 300, forms an example of valve dispenser means, operating between said main compartment 24*a* and said dispenser duct 30 and normally closed, suitable, in an open configuration during said active step, to permit the passage of the liquid from the main compartment 24*a* towards the dispenser duct 30 upon exceeding a threshold pressure.

Preferably the deformation of the membrane 202 is limited by the mouth wall 96.

In a triggering configuration, for example in a limit dispensing configuration in which the piston 26 is in its limit forward position, in which the volume of the main compartment 24*a* is minimal if not null, the piston 26 interferes mechanically with the valve dispenser means, forcing the deformation of the membrane, if necessary in such manner forcing the detachment of the membrane 202 from the abutment wall 308 of the sleeve 300.

In particular, the main side 26*c* of the piston 24 comes into contact with the lip 210, (for example, the lip 210 is housed in the recess 26*d* of the piston 26), pushing it along the pressure axis Y. The tang 208 is affected by the action of the piston on the lip 210 which pushes on the membrane 202, forcing its detachment where necessary from the abutment wall 308.

The piston 26, the lip 210 and the tang 208 form an example of mechanical trigger means suitable for mechanically forcing the aperture of the valve dispenser means, and in particular suitable for forcing the deformation of the membrane 202; in yet other words, said mechanical trigger means are suitable for forcing the detachment of the membrane 202 from the abutment wall 308.

When the trigger is released, the elastic return means move the piston 26 or trigger 28 from the limit dispensing position towards the rest position.

The negative pressure which is formed in the main compartment 24*a* of the pressure chamber 24 and the elastic return of the membrane 202, recall the membrane 202 to sealingly engage with the abutment wall 308, restoring the condition of fluidic separation between the main compartment 24*a* of the pressure chamber 24 and the dispensing duct 30.

Moreover, the negative pressure which is formed in the main compartment 24*a* of the pressure chamber 24 acts on the lip 210 of the main body 200 so as to open the tang 208. The liquid contained in the compartment of the container is thus aspirated towards the aspiration duct 90, the mouth 94, the intermediate compartment 220, as far as the main compartment of the pressure chamber 24.

At least for a section of the return step, the vent duct 98 is in communication with the outside environment, so that the air can be aspirated in the container compartment before being closed again by the sealing lips 26*a*, 26*b* of the piston 26.

Figure 12:
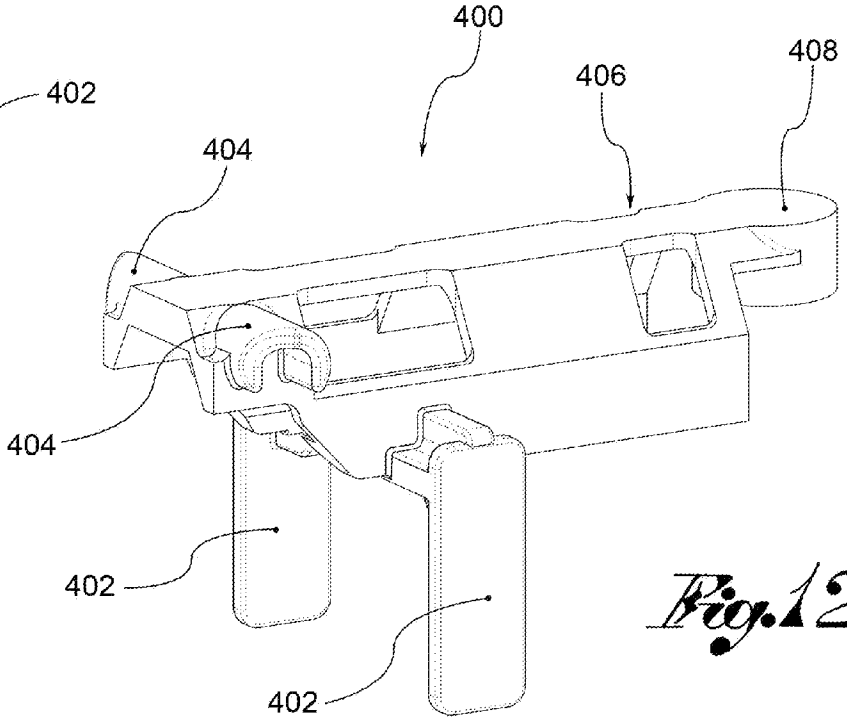
FIG. 12 shows the integrated elastic element of the dispenser head, according to a further embodiment.
Figure 11:
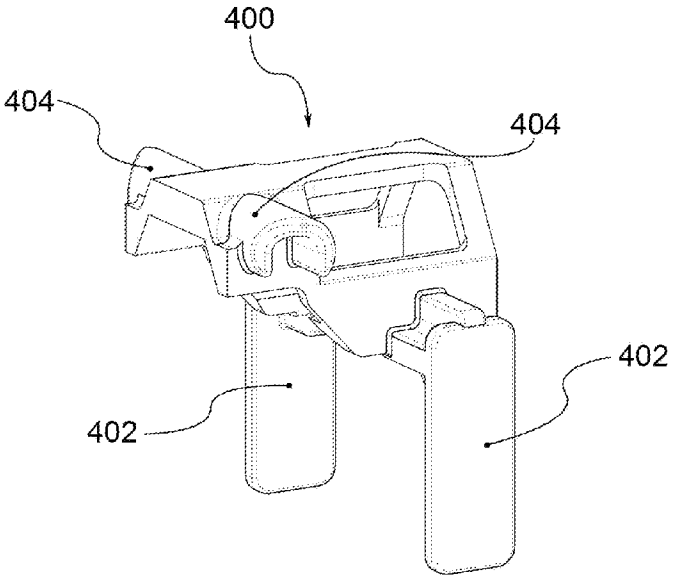
FIG. 11 shows an integrated elastic element of the dispenser head in FIG. 1.
Figure 13:
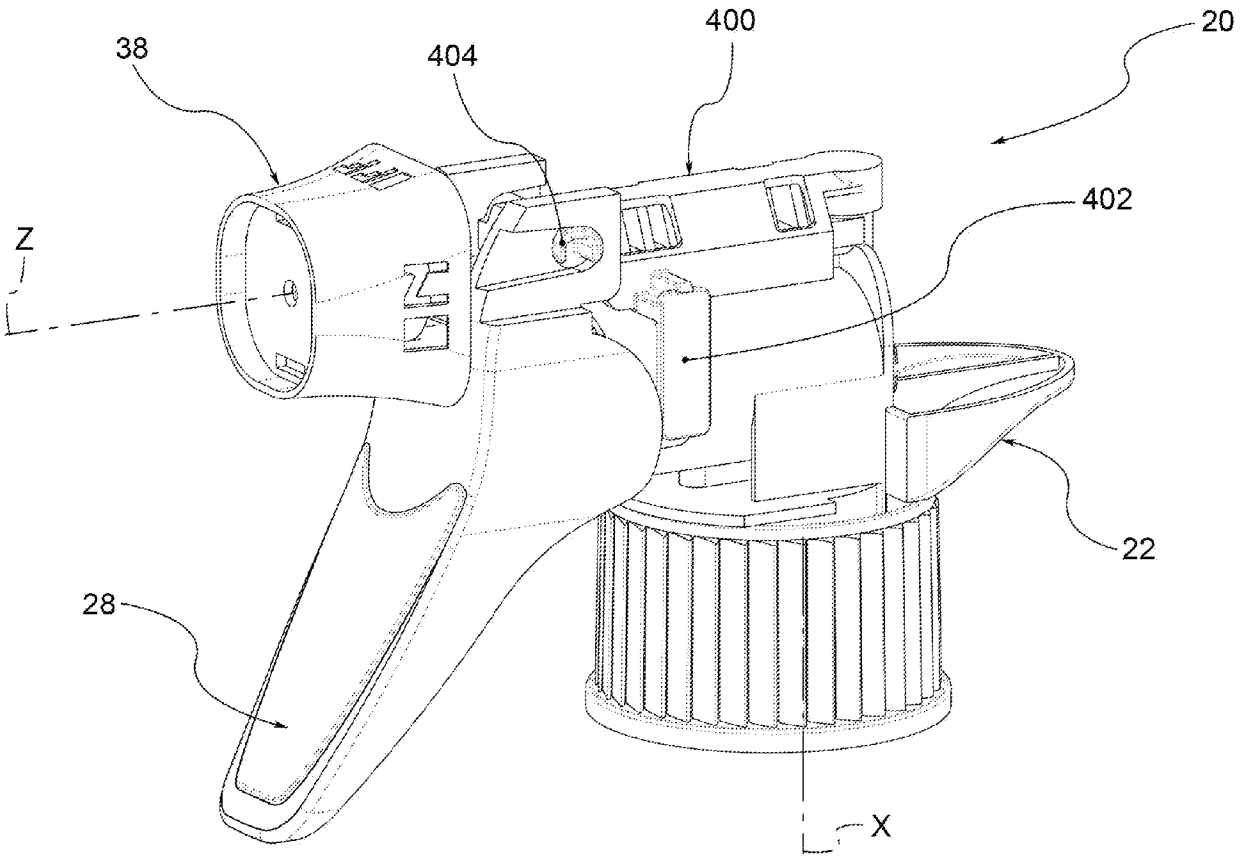
FIG. 13 shows the frame and the integrated elastic element of FIG. 12 engaged.

According to a preferred embodiment, the elastic return means comprise a return element 400 in a single piece, suitable for being applied to the frame 22, preferably astride the dispenser duct 30 (FIGS. 12, 13 and 14).

Preferably said elastic element 400 comprises a pair of tabs 402, positioned on both sides of the dispenser duct 30, suitable for engaging with the trigger 28, acting on it to return it to the position of the rest configuration.

Preferably moreover, the elastic element 400 comprises ears 404, positioned on both sides of the dispenser duct 30, engaged with the trigger 28, to form hinging points.

According to a preferred embodiment (FIG. 12), the elastic element 400 is elongated, that is to say comprises a tail 406 which extends along the dispenser duct 30, on the side opposite the nozzle 38, as far as the proximal end 34 of said dispenser duct 30.

Preferably the tail 306 comprises a plug 408 which engages the frame 22 so as to close off the passage joining the dispensing aperture 29 to the proximal end 34 of the dispenser duct 30, from the outside environment.

Innovatively, the dispenser device according to the present invention makes it possible to achieve highly repeatable behaviour of the dispenser device, in that the aperture of the valve dispenser means is accurate and repetitive while at the same time maintaining a simple structure thanks to the integration of the valve functions in a few components.

It is clear that a person skilled in the art may make modifications to the dispenser device described above so as to satisfy specific requirements. Such modifications are also included within the sphere of protection as defined by the following claims.

The invention claimed is:

1. Dispenser head attachable to a container of a trigger dispenser device, comprising:

a) a pressure chamber defining an interior, and a piston operable by a trigger and sliding in a main compartment of the pressure chamber along a pressure axis, operating under pressure in the main compartment during an active step and operating in negative pressure in the main compartment during a return step;

b) a dispenser duct suitable for being in communication with the main compartment of the pressure chamber, for dispensing liquid from the interior;

c) a dispenser valve, operating between the main compartment and the dispenser duct and normally closed, suitable, in an open configuration during the active step, to permit passage of the liquid from the main compartment towards the dispenser duct upon exceeding a threshold pressure;

d) wherein the trigger is suitable to actuate the piston for mechanically operating on the dispenser valve to force the dispenser valve towards the open configuration;

and wherein the dispenser valve comprises a flexible membrane and an abutment wall of a sleeve rigid in relation to the membrane, which defines an opening suitable for placing the main compartment in communication with the dispenser duct, wherein the membrane, in a rest configuration, closes the opening;

the dispenser head comprises a check valve suitable for preventing return of the liquid from the main compartment to an inner compartment of the container during the active step, and the check valve comprises a tang projecting axially from the membrane and a lip partially separated from the tang by a cut;

the piston has a main side with a recess, so that the lip is housed in the recess of the piston when the piston engages the dispenser valve.

2. Dispenser head according to claim 1, wherein the dispenser valve is contained in the pressure chamber.

3. Dispenser head according to claim 1, wherein a projection of the opening along the pressure axis is at least partially contained on a main surface of the piston.

4. Dispenser head according to claim 1, wherein the piston is suitable to force detachment of the membrane from the abutment wall of the sleeve.

5. Dispenser head according to claim 1, wherein the pressure chamber is delimited on the bottom by a bottom wall having a mouth suitable for placing the main compartment in communication with a compartment inside the container and a dispenser opening, suitable for placing the main compartment in communication with the dispenser duct.

6. Dispenser head according to claim 1, comprising an elastic return suitable for operating on the piston or on the trigger to return the piston or the trigger to the rest configuration.

7. Dispenser head according to claim 6, wherein the elastic return comprises a return element, made in a single piece, comprising ears for the hinging of the trigger.

8. A trigger dispenser device, comprising:

a container defining an interior, the interior having an inner compartment for containment liquid;

a dispenser head attached to the container; the dispenser head comprising:

a) a pressure chamber and a piston operable by a trigger and sliding in a main compartment of the pressure chamber along a pressure axis, operating under pressure in the main compartment during an active step and operating in negative pressure in the main compartment during a return step;

b) a dispenser duct suitable for being in communication with the main compartment of the pressure chamber, for dispensing the liquid from the inner compartment;

c) a dispenser valve, operating between the main compartment and the dispenser duct and normally closed, suitable, in an open configuration during the active step, to permit passage of the liquid from the main compartment towards the dispenser duct upon exceeding a threshold pressure;

d) wherein the trigger is suitable to actuate the piston for mechanically operating on the dispenser valve to force the dispenser valve towards the open configuration;

and wherein the dispenser valve comprises a flexible membrane and an abutment wall of a sleeve rigid in relation to the membrane, which defines an opening suitable for placing the main compartment in communication with the dispenser duct, wherein the membrane, in a rest configuration, closes the opening;

the dispenser head comprises a check valve suitable for preventing return of the liquid from the main compartment to the inner compartment of the container during the active step, and the check valve comprises a tang projecting axially from the membrane and a lip partially separated from the tang by a cut;

the piston has a main side with a recess, so that the lip is housed in the recess of the piston when the piston engages the dispenser valve.

* * * * *